United States Patent [19]

Yamaguchi

[11] 4,413,487

[45] Nov. 8, 1983

[54] HAND-OPERATED KNITTING MACHINE, METHOD OF CASTING ON AND KNIT ARTICLE OBTAINABLE ON THE MACHINE

[75] Inventor: Yoshimasa Yamaguchi, Kodaira, Japan

[73] Assignee: Silver Seiko Ltd., Tokyo, Japan

[21] Appl. No.: 401,606

[22] Filed: Jul. 26, 1982

[30] Foreign Application Priority Data

Jul. 29, 1981 [JP] Japan ..... 56-117822

[51] Int. Cl.[3] ..... D04B 7/00

[52] U.S. Cl. ..... 66/60 H; 66/172 R

[58] Field of Search ..... 66/60 H, 64, 147, 172, 66/169 A, 117, 169, 109

[56] References Cited

U.S. PATENT DOCUMENTS 3,320,773 5/1967 Start et al. ..... 66/109

*Primary Examiner*—Ronald Feldbaum

*Attorney, Agent, or Firm*—Kenway & Jenney

[57] ABSTRACT

Each of a plurality of sinker elements on a needle bed having a plurality of knitting needles of a hand-operated knitting machine has a vertically extending, endwise open slot formed at its forward end. For casting on, an end segment of a knitting yarn is successively passed through the respective slots of the sinker elements to twist the end segment with another segment of the yarn forming a first row. Needle loops in the first row are drawn from between the twisted yarn segments, thereby providing a knit article with a closed edge which will not be loosened by a pull at the edge of the article.

4 Claims, 6 Drawing Figures

HAND-OPERATED KNITTING MACHINE, METHOD OF CASTING ON AND KNIT ARTICLE OBTAINABLE ON THE MACHINE

BACKGROUND OF THE INVENTION

This invention relates to a hand-operated knitting machine and a method of casting on in a hand-operated knitting machine. The invention also relates to a knit article obtained by such a method.

Conventionally, casting on in a hand-operated knitting machine, which includes a plurality of individually movable knitting needles, with the initial formation of stitches on the knitting needles being effected using a specially provided device such as a cast on comb, a ravel cord, a cast on fabric or net, or the like. These conventional techniques, however, are disadvantageous in that substantial skill is required to successfully effect casting on by manual operations of such a device as a cast on comb and additionally, troublesome operations are necessary to remove the cast on comb or the like from an article being knit after the casting on has been completed.

These techniques commonly provide an open edge to a knit article so that, if a yarn at a first row of stitches at the edge is pulled, such stitches at the first row, and sometimes further stitches in succeeding rows, may be loosened. Accordingly, different techniques are preferably used which can provide a closed edge to a knit fabric which will not be loosened by a pull at a part thereof. One of such techniques includes winding of a yarn successively around the knitting needles. But this technique is also disadvantageous in that it requires extremely troublesome operations to draw a yarn to wind around one after another of the stem portions of a large number of operative knitting needles. Besides, if the yarn is wound too tightly around the knitting needles, back and forth movement of the knitting needles may be interfered with, thereby, resulting in the necessity of skill to attain successful casting on by this technique. If a knitting machine is designed as a toy knitter or a hobby knitter which is intended for use by children or beginners, consideration must be made for these circumstances.

SUMMARY OF THE INVENTION

Accordingly, it is an object of the invention to provide a method of casting on in a hand-operated knitting machine which eliminates such drawbacks of conventional methods as described above.

It is another object of the invention to provide a novel structure of a knitting machine which can be suitably applied to a hobby or toy knitter for use by beginners or children in which operations for casting on can be effected easily.

It is another object of the invention to provide a hand-operated knitting machine in which operations for casting on can be performed easily without skill.

It is a further object of the invention to provide a novel knit article which has a closed edge thus preventing the article from being loosened easily.

One way of carrying out the invention is described in detail below with reference to the accompanying drawings which illustrates, by way of example, one embodiment of the invention, and in which:

DETAILED DESCRIPTION OF THE PREFERRED EMBODIMENT

Figure 1:
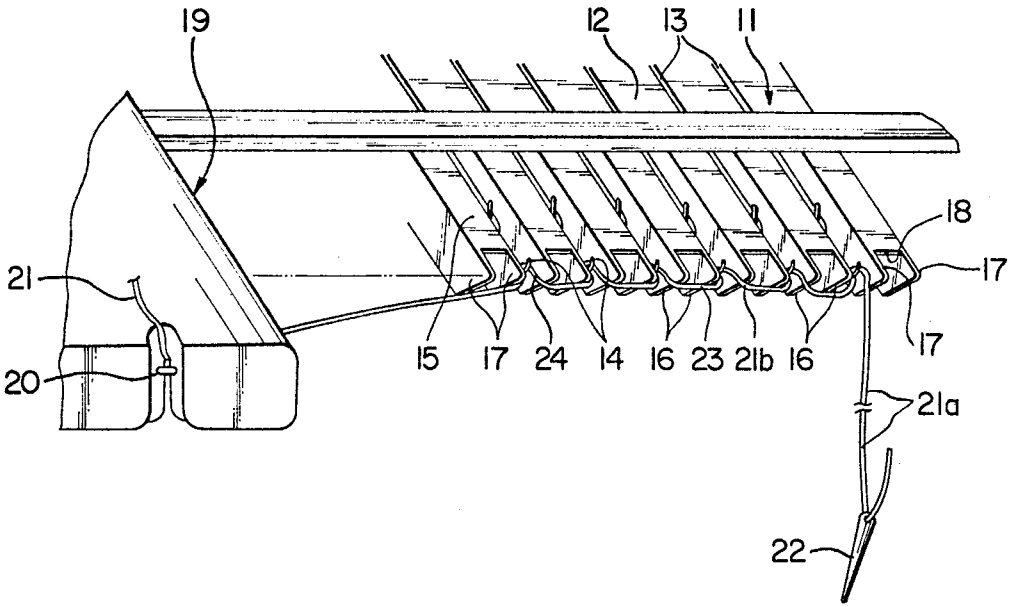
FIG. 1 is a perspective view showing part of a knitting machine according to the present invention after a carriage has been slid in a direction as a first step of the method according to the present invention.
Figure 4:
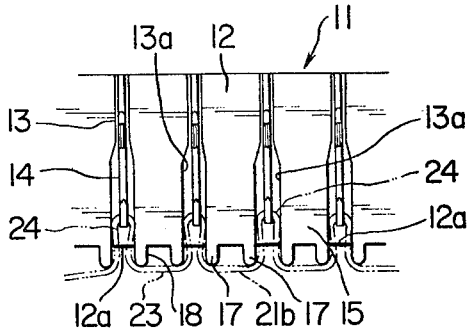
FIG. 4 is a plan view, in a rather enlarged scale, of part of the machine.
Figure 5:
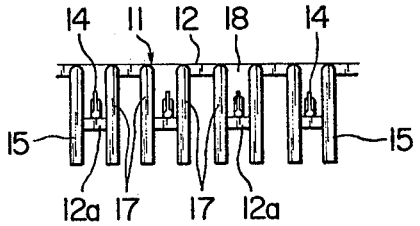
FIG. 5 is a front elevational view of part of the machine.

Referring first to FIGS. 1, 4 and 5, there is illustrated a hand-operated knitting machine having a needle bed 11 which includes a bed plate 12 made of a suitable hard synthetic resin material. The bed plate 12 has a plurality of needle tricks 13 formed therein in which knitting needles 14 are tricked for back and forth movement. Each needle trick 13 is widened as at a forward end portion 13*a* thereof, as seen in FIG. 4, to allow a limited lateral deflection of a forward portion of a needle 14. Each knitting needle 14 has a butt (not shown) extending upwardly from the top of the bed plate 12. Sinker elements 15 are integrally formed along a forward edge 12*a* of the bed plate 12 in alternate relationship with the knitting needles 14 and in parallel relationship with each other and also with the needle tricks 13 therebetween.

Each sinker element 15 extends forwardly from the forward edge 12*a* of the bed plate 12 and is bifurcated at a forward end thereof (FIG. 4) to define a vertically extending, forwardly open slot or recess 18 between a pair of parallel walls 17 thereof. The vertical recess 18 is sufficient to allow a needle element such as a tapestry needle 22 (FIG. 1) to pass therethrough. A front edge 16 of each wall 17 is rearwardly inclined such that the top end thereof is located forwardly of the bottom end thereof.

A knitting carriage 19 (only a part is shown in the drawings) is mounted for sliding movement on and across the needle bed 11 and has a yarn feeder 20 provided on a front portion thereof. The carriage 19 further has a knitting cam arrangement (not shown) provided on the rear side thereof which, when the carriage 19 is moved across the needle bed 11, is engaged with the butts of the knitting needles 14 to cause the knitting needles to move forwardly and backwardly for knitting a desired fabric.

Referring now to FIGS. 1 to 4, the method of casting on in such a knitting machine is described in detail. Initially, several knitting needles 14 which are being used or operated later for knitting, hereinafter referred to as "operative knitting needles", are first manually moved from a retracted rest position to an intermediate operative position (in the drawings, it is depicted that six knitting needles 14 are used as such "operative" knitting needles). A desired yarn 21 is threaded through the yarn feeder 20 of the carriage 19 and is drawn therethrough to provide an end segment 21*a* of the yarn 21 which has a length two or three times the width or distance between the leftmost and rightmost ones of the operative knitting needles 14. The carriage 19 is then slid on the needle bed 11 in a direction, for example, from right to left as viewed in FIG. 1, with a fresh second segment 21*b* of the knitting yarn 21 being fed onto the operative knitting needles 14 through the yarn feeder 20. As a result, as seen in FIG. 1, the second segment 21*b* of the yarn 21 is carried on hooks of these needles 14 while portions of the yarn segment 21*b* between adjacent operative knitting needles 14, that is, sinker loops 23 of the second yarn segment 21*b*, extend horizontally in front of and across the slots 18 between the parallel walls 17 at the forward ends of the corresponding sinker elements 15. Thus, each slot 18 is partially closed on the front side thereof by a sinker loop 23, as particularly seen in FIG. 4.

Figure 2:
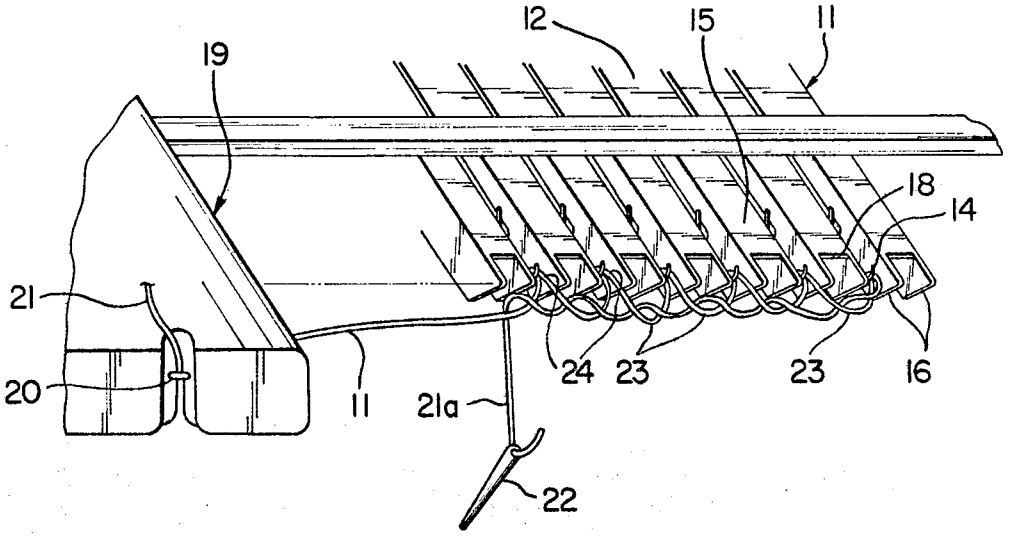
FIG. 2 is a similar view showing the machine after completion of a second step of the method to wind or twist an end segment of a yarn with or around sinker looks formed by the preceding carriage movement.
Figure 3:
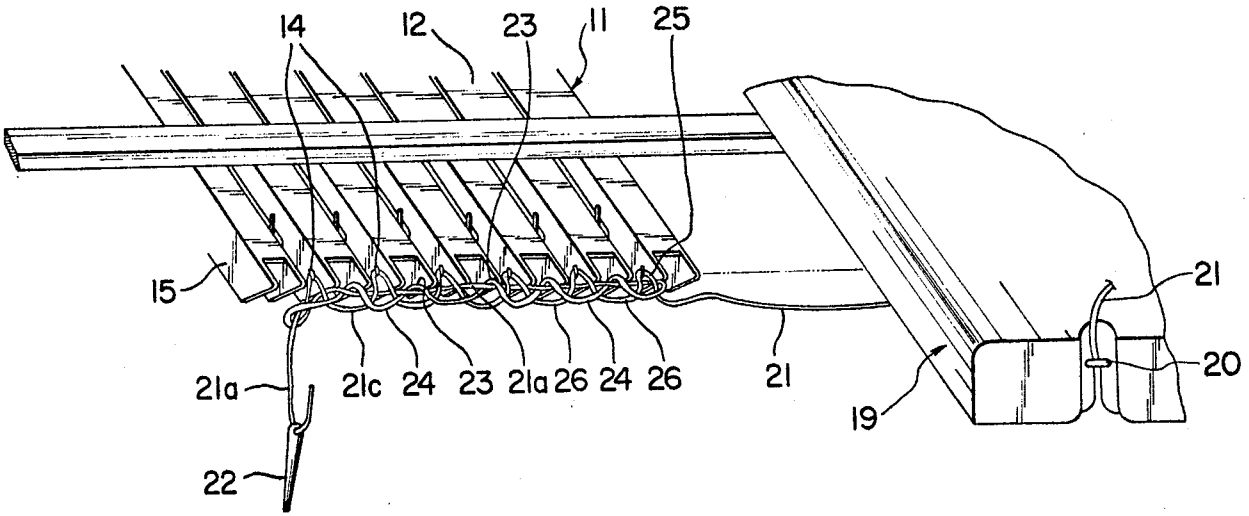
FIG. 3 is a similar view showing the machine after completion of the final step of the method to move the carriage in the opposite direction.

Then, the end segment 21*a* of the yarn 21 may be threaded into a tapestry needle 22, and the tapestry needle 22 is manually passed from above through the vertical slot 18 of the sinker element 15 leftwardly adjacent the rightmost operative knitting needle 14 as viewed in FIG. 2 and drawn forwardly thereby causing the yarn end segment 21*a* to wind, as in the form of a loop, around the sinker loop 23 of the yarn 21 adjacent that sinker element 15. The same sequence of operations, i.e., passing the tapestry needle 22 through the slot 18 of a sinker element 15 from above and drawing it forwardly, will be repeated for the remaining leftward successive sinker elements 15 and sinker loops 23 so that most of the end segment 21*a* of the yarn may be knitted or twisted with the sinker loops 23 of the yarn 21 (FIG. 3). If there remains a sufficient length of the yarn end segment 21*a*, the same sequence may preferably be repeated in the reverse direction to have each sinker loop 23 twisted with two turns or loops of the yarn 21 in order to obtain a more solid edge of a knit article. Otherwise, a free end of the yarn end segment 21*a* having the tapestry needle 22 threaded therewith is suspended on a segment of the yarn 21 between the hook of the leftmost operative knitting needle 14 and the yarn feeder 20 of the carriage 19 as shown in FIG. 2.

Subsequently, the carriage 19 is manually slid in the opposite direction from left to right as viewed in FIG. 2 and 3. During this movement of the carriage 19, a new third segment 21*c* of the yarn 21 is fed to the operative knitting needles 14 while they are operated by the cam arrangement (not shown) on the carriage 19 for knitting a plain knit fabric with the yarn 21. As a result, an old needle loop 24 which has been on each of the operative knitting needles 14 is knocked over while the newly fed yarn segment 21*c* is carried by the hooks of the operative knitting needles 14 and drawn from between the first end and second segments 21*a*, 21*b* of the yarn between two adjacent turns of one around the other of the two segments 21*a*, 21*b* to form new needle loops (FIG. 3). Thus, the casting on operation is completed and it will be followed by conventional knitting operations for succeeding new rows of stitches for an intended knit article.

Figure 6:
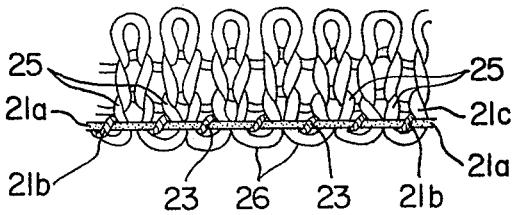
FIG. 6 is a diagrammatic representation showing the structure of a knit fabric according to the present invention.

An exemplary knit article obtained by this method is diagrammatically illustrated in FIG. 6. As seen from FIG. 6, needle loops 25 in a first row of stitches are drawn from between the first end and second segments 21*a*, 21*b* of the yarn 11 between adjacent wound turns of one around the other of the two yarn segments 21*a*, 21*b*, that is, between adjacent sinker loops 23 of the second yarn segment 21*b* which extend around the first yarn segment 21*a*. On the other hand, each of sinker loops 26 in the first row of the stitches extends around two legs of a sinker loop 23 of the second yarn segment 21*b* which again extends around the first yarn segment 21*a*. Thus, it can be easily seen that the first and second segments 21*a*, 21*b* of the yarn 21 are interlaced with the stitches in the first row and also in the second row so that a pull at a portion of the edge of the knit article would not cause loosening of the knit article. Thus, a closed edge of a knit article can be easily attained.

I claim:

1. A hand-operated knitting machine having a needle bed containing a plurality of knitting needles mounted for individual back and forth movement therein, said needle bed having a plurality of sinker elements secured to an edge thereof and disposed in alternate relationship with said knitting needles, each of said sinker elements being bifurcated at a free end thereof to form a vertically extending, endwise open slot or recess which is sufficient to allow a needle element to pass therethrough.

2. A hand-operated knitting machine as claimed in claim 1, wherein said slot of each sinker element is defined by a pair of parallel walls extending from said edge of said needle bed.

3. Method of casting on in a hand-operated knitting machine of the type which includes a needle bed having a plurality of knitting needles mounted therein for individual back and forth movement and a plurality of sinker elements mounted securely on a forward edge of said needle bed in alternate relationship with said knitting needles, and a knitting carriage mounted for sliding movement on said needle bed to cause said knitting needles to move for knitting operation, said carriage having thereon a yarn feeder for feeding a yarn to said knitting needles, said method comprising the steps of: moving said carriage in a direction across said needle bed with a yarn being fed to operative ones of said knitting needles while an end segment of the yarn longer than the width of a range of the operative knitting needles is left suspending from the first operative knitting needle so that another segment of the yarn extends alternately across hooks of the operative knitting needles and forward ends of said sinker elements, each of said sinker elements being bifurcated at the forward end thereof to form a vertically extending, forwardly open slot; passing the end segment of the yarn successively through said slots of the sinker elements corresponding to the operative knitting needles so that the yarn end segment may be helically wound around or twisted with sinker loops of said another segment of the yarn; and moving said carriage in the opposite direction across said needle bed with the yarn being fed through said yarn feeder.

4. A method of casting on as claimed in claim 3, wherein the end segment of the yarn has a needle element needle threaded therewith so that said needle element is manually passed successively through said slots of said sinker elements together with the yarn end segment.

* * * * *